US006110560A

United States Patent [19]

Abrams

[11] Patent Number: 6,110,560

[45] **Date of Patent: *Aug. 29, 2000**

[54] MIXED-MEDIA FLOCK HEAT TRANSFER WITH INSERT MATERIAL

[75] Inventor: Louis B. Abrams, Larimer County, Colo.

[73] Assignee: High Voltage Graphics, Inc., Fort Collins, Colo.

[ * ] Notice: This patent is subject to a terminal disclaimer.

[21] Appl. No.: 09/250,615

[22] Filed: Feb. 16, 1999

Related U.S. Application Data

[60] Provisional application No. 60/074,833, Feb. 17, 1998.

[51] Int. Cl.[7] ..... B05D 1/14

[52] U.S. Cl. ..... 428/90; 428/94; 428/914

[58] Field of Search ..... 428/90, 94, 914

[56] References Cited

U.S. PATENT DOCUMENTS 4,810,549 3/1989 Abrams et al. .

5,047,103 9/1991 Abrams et al. .

*Primary Examiner*—Terrel Morris
*Assistant Examiner*—Arti Singh
*Attorney, Agent, or Firm*—Paul M. Denk

[57] ABSTRACT

A mixed media flock transfer, including an insert material, having a base sheet, with its surface area coated with a release adhesive, a patterned flock material having ends adhering to the release adhesive of the base sheet, in the form of a predetermined pattern, an insert material also having a predetermined pattern and which produces a design image being inserted at certain locations within the patterned flock, which when combined with the design pattern of the flock material, produces an overall image, the insert material also being secured to the base sheet by a pressure sensitive adhesive, both the patterned flock and insert material having a binding adhesive applied to their exposed surfaces, whereby the design image may be secured by the binding adhesive when transferred onto a product.

10 Claims, 2 Drawing Sheets

MIXED-MEDIA FLOCK HEAT TRANSFER WITH INSERT MATERIAL

This application claims benefit of provisional application No. 60/074,833 filed Feb. 17, 1998.

BACKGROUND OF THE INVENTION

This invention relates to a heat applied applique or plush transfer which may be applied to clothing, such as T-shirts, sweatshirts, or other clothing, or other materials, and, in particular, to a transfer having certain component(s).

Heat applied or iron-on type of transfers generally have a flocking in the form of a desired design which is secured to a backing. The flocked design has binder adhesive plus a hot melt glue applied thereto, to adhere the transfer to a piece of clothing. Some transfers include inserts made of material other than flocking.

The concept of applying a plush textured transfer to clothing, and its initial construction and assembly, is readily disclosed in my prior patents of which I was a co-inventor, including U.S. Pat. No. 5,047,103, relating to a method for making flock applique and transfers. Furthermore, U.S. Pat. No. 4,810,549, shows another form of plush textured multicolored flock transfer. In these particular embodiments, as shown in the prior art, the transfers are made integrally, wherein the assembled applique is formed completely of flocking materials, whether it be singular color, or multicolored flock transfers. Prior flocked transfers, and their method of application, previously required hot melt lamination which can be degrading to the structure of the transfer itself, reduce its integrity, which can also be detrimental to achieving the clean edges for the finished transfer, and result in less durability for the finished product. In addition, prior transfers, because of the incompatible hot melts, could not and would not cooperate with other types of inserts, such as holograms, or other reflective material, due to the lack of such hot melt to adhere and hold such type of insert material to the transfer, and the textile to which it is applied.

BRIEF SUMMARY OF THE INVENTION

The principal object of the current invention is to fabricate a plush transfer having an insert that may be incorporated into manufacturing with the surrounding or associated plush flock transfer, in its assembly.

Briefly stated, in summary, this invention contemplates a transfer which is securable to clothing, or other items, and includes a flocking layer formed in a precise and desired pattern, and an insert formed in an equally desired pattern with each of the patterned materials providing and exhibiting a particular image, in their combined assembly, when formed into a transfer, and applied to clothing, or the like. In combination, the flocking and insert art formed to create a desired design. The insert is secured in association with the flocking, so that the flocking and insert may be applied to an item of clothing in a single application step. The application of the transfer, once assembled, is dictated by the.assembly and fabrication of the transfer itself, and the type of adhesive used to effect an application of the transfer during its usage. In its manufacture, the fabrication of the transfer commences with the application of flocking material to a release sheet, in the general pattern desired for the flock to be applied to an item of clothing, etc. The flock is applied to the release or base sheet, generally in a manner as previously described in the previous U.S. Pat. No. 5,047,103, and U.S. Pat. No. 4,810,549. The flocked material may have various locations where the insert material may be applied, and which formed the particular designs desired to be applied through application of the transfer, to the finished product.

Essentially, these insert material type components, as previously referred to, may include a glass bead coated reflective material, a hologram, or any of the other related type materials known in the trade, or other materials such as polyester film, shiny aluminum, or other metal or the like.

In the next step for manufacture of the transfer of this invention, the insert material is cut to the design required in the flock of the transfer and to which the patterned and designed insert, whether it be any one of the type of materials as previously explained, is to be reasonably precisely located, so as to add that aspect of functionality to the finished transfer, when applied to an item of clothing, or other textile, and the like.

As previously explained, the insert material is now combined with the previously flocked material, as formed upon its base sheet, and is pre-cut and patterned either as a non-compatible type of insert, any type of reflective material, any form of hologram, or any of the other types of materials as previously reviewed, which is applied to the transfer either at a location where the transfer has been flocked to a particular design, having a void therein, or some other pattern within it or around it, and at this stage of assembly, the transfer is ready for application by peeling off the carrier paper from the pressure sensitive adhesive, and adhering the component of the transfer to the previously flocked base sheet.

When assembled in this manner, the exposed portion of the flock, upon its base sheet, and the back of the non-compatible component, will be exposed upwardly from its base sheet. To these two components, there is applied a screen print permanent latex fiber adhesive over the fibers to be transferred, and a coating of a hot melt powder, in the particular overall design of which the transfer is to be applied to clothing, the hot melt powdered coating is allowed to dry, is vacuum brushed and cured, in preparation for application of the transfer to an item of clothing.

In the fmal step, transfer is then applied to clothing, or other cloth material, heat is applied to it, whether it be by an iron-on process, or by other heat applicator and once applied, the heat transfer and insert are peeled off, leaving the applied patterned flock on the clothing, with the insert material being exposed externally, as a rather unique form of applique that may be applied and permanently secured to an item of clothing, or other material.

Once formed, this style of transfer may be transferred onto athletic shirts, such as a football shirt, basketball shirt, exhibiting a school name, the name of the player, the number of the player involved, the name of the college or professional team, such transfers being formed for disclosure of any of an infinite variety of patterns, as required upon any type of supporting surface, and desired by the end user.

Broadly, the concept of applying a mixed type of media means to a flocked transfer, or more specifically, its insert material, can be achieved in three possible scenarios. One, the reflective insert is perfectly positioned with the flocked window, although achieving such is a very delicate operation. Secondly, the reflective insert is overlapping of the window within the flock, as with normal, compatible textile inserts, but there may be problems with this in that the hot melt utilized with the flock will not adhere to the glass bead or other insert material surface, whether it be reflective or otherwise, so it also requires a rather delicate operation. Thirdly, the procedures performed where the reflective insert is made slightly smaller than the flocked window, and this may present the more obtainable opportunity for making the transfer other than incorporating the reflective insert into the transfer, while it is being manufactured, as shown and described in my previous patents. In this instance, there may always be a gap around the edge of the insert material, and between it and the edge of the bond/hot melt print, but this can be overcome as described hereinafter.

Initially, one can use heat to apply an overlapping hot melt film layer to the reflective piece that can be generally matching the bond in opacity color. Additionally, the overlapping hot melt film layer will then pick up fibers from the flocked sheet to fill in the edge gap, making the flocked design look more complete. Finally, the overlapping hot melt film layer may need to be fabricated of polyurethane, or some other type of resin, that does not flow so it does not migrate or ooze through the face of the flocked design; and in the case of a non-flowing polyurethane, it should then be laminated to another layer of normally flowing type of hot melt film like polyester. Tests have indicated that even a polyester/polyurethane/polyester film material, so that the polyester flows in both directions, into the flock and into the textile substrate, may provide a convenient manner for forming a multi-media type of transfer, and which may be one that can be easily handled by a plant during routine manufacture.

It is, therefore, the principal object of this invention to provide an iron-on or other heat applied transfer or pressure sensitive applied transfer, which may be applied to clothing, other cloth components, and the like.

Another object of this invention is to provide a transfer that can be applied to almost any surface.

Another object of this invention is to provide such a transfer which includes an insert.

A further object of this invention is to provide a transfer in which the insert is easily applied to the clothing at the same time, and simultaneously with, as the flocking portion of the transfer is applied to the clothing.

Still another object of this invention is to form a transfer that can be applied simultaneously to any item of clothing, or other cloth material, and not requiring the separate application of a component of the transfer, under any subsequent procedure.

These and other objects will become more apparent to those skilled in the art in light of the following disclosure, and the accompanying drawings.

DESCRIPTION OF THE PREFERRED EMBODIMENT

Figure 1:
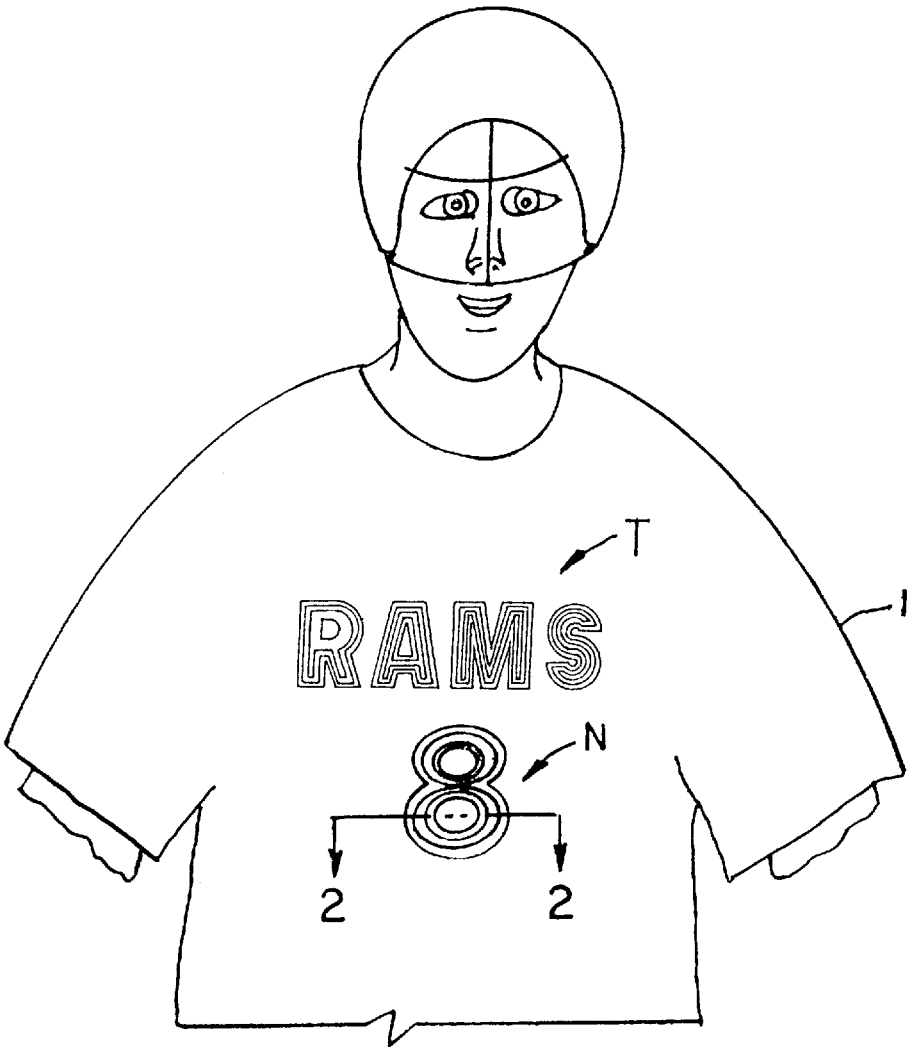
FIG. 1 is a view of a person, namely a football player, wearing a game shirt having the transfer of the present invention applied thereto.

In referring to the drawings, and in particular FIG. 1, the transfer of this invention, as can be generally seen at the vicinity T, has been previously applied to the shirt, such as the football shirt 1, as noted. As can be seen, the applique of this invention may include numbers, letters, names, such as the name Rams, or the name of any other team, the college name, high school name, numerals, and the like, of the type that are normally applied to the game shirts, or other shirts, or even jackets, etc. Any type of transfer can be formed and applied for this purpose.

Figure 2:
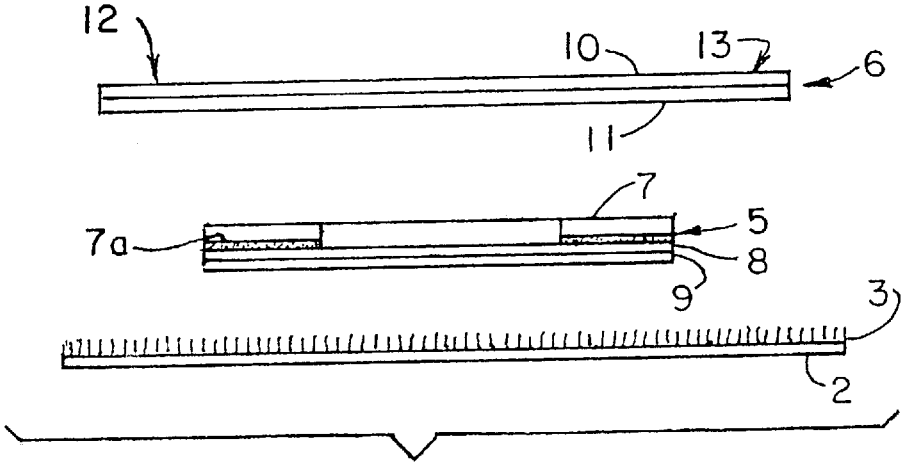
FIG. 2 is a sectional view taken through the number of the transfer, along the line 2—2 of FIG. 1, with the transfer being exploded to disclose its various components.

The applique of this invention includes a series of laminar layers, which are formed to provide the overall transfer, that is ready for shipment to the clothing manufacturer, to have the transfer applied directly to the clothing, in preparation for delivery to the teams, stores, and the like. As can be seen in FIG. 2, the flocked applique is generally formed with its base sheet 2, and has patterned flock material applied generally thereon, as at 3, in the manner as previously described in the two identified patents.

Two additional components of the transfer are shown at 5 and 6, and these layers may also be laminated into position, and in the following manner, during the formation of the transfer, in preparation for its usage. As shown at layer 5, the reflective material, as at 7, has a pressure sensitive adhesive 8, with its release sheet 9, applied thereto, and the combination will have been cut into the configuration of the desired reflective material within the numeral 10, as shown in FIG. 1. Then, the release sheet 9 will be removed, and the combination of the reflective material 7, and its pressure sensitive adhesive 8, will be applied to the flocked surface 3. This will provide a means for adherence of the reflective material temporarily to the surface of the flock 3, and its release sheet 2. Then, a hot melt adhesive, as at 10, is then applied in combination with a latex adhesive 11, onto the surface of the flock 3, and overlies the applied insert 5, through its application. Once this is done, the transfer is generally prepared for subsequent usage, and will be noted that the combined hot melt and latex adhesive extends beyond the edges of the insert 5, as at the location 12 and 13, so as to allow for the application and retention of an outer edge of flock, to the textile material to which the transfer is applied, to form the style of numeral N, as shown.

Figure 3:
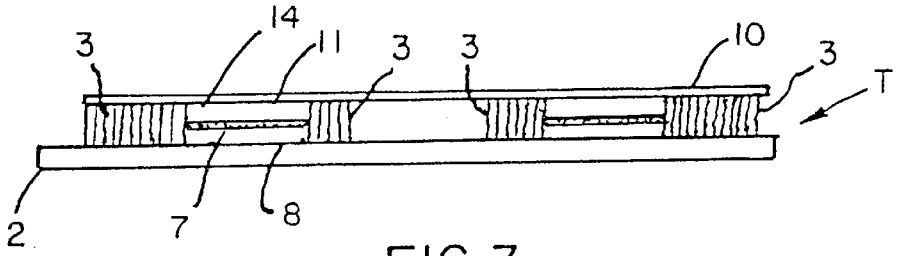
FIG. 3 is a view of the assembled transfer of FIG. 2, and having a hot melt adhesive applied to its upper and the outer surface of the combined flock and reflective material.
Figure 4:
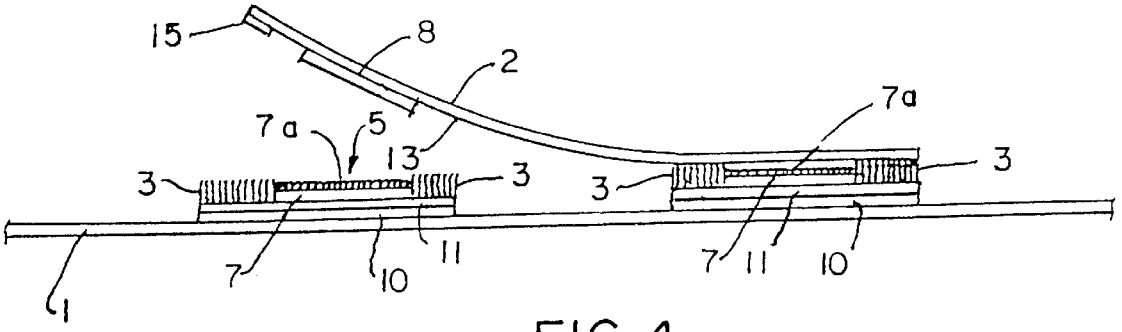
FIG. 4 is an inverted view of the transfer of FIG. 3, after its inverting and heat application to the surface of the shown shirt, with parts of the transfer being peeled away after its application to said shirt.
Figure 5:
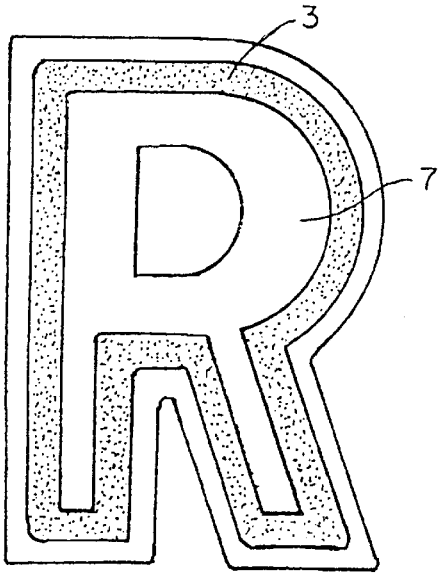
FIG. 5 shows an enlarged view of one of the letters formed of the transfer of this invention, as disclosed in FIG. 1.

As can be seen in FIG. 3, the Transfer T is prepared, the base sheet 2, with the flock 3 is prepared. The insert material backing 7, with its reflective surface 7*a* is secured to the surface of the flocked sheet 2, upon peel away of the release sheet 9 from the pressure sensitive adhesive 8. When the components of the transfer are assembled or manufactured into this condition, the upper edges of the patterned and designed flock 3, in addition to the exposed surface of the adhesive and insert material 7, is screen printed with the permanent latex fiber adhesive 11, which is coated with a hot melt powder 10, as along its surface. This coating is done in a delicate manner, so as not to dislodge the previously applied reflective material insert, comprising the combination of components 5 and 6, as previously explained. The coated hot melt powder is then dried, vacuum brushed, and cured, to prepare it for application to a shirt, or other cloth or related surface. In this condition, the entire transfer is assembled, and ready for usage. Then, the transfer may be applied to the surface of a shirt 1, or any other cloth or related surface, and it is subjected to heat, whether it be an iron, or other heat application, so as to soften the hot melt 10 and latex 11, and provide for its adherence to the surface of the shirt 1. The hot melt is very tenacious in its application, and when applied in this manner, as can be seen in FIG. 4, the hot melt readily adheres the insert material 7 and its reflective surface 7*a,* and the flock 3, to the surface of the shirt 1. This adheres the backing material 7 of the reflective beaded surface 7*a* to the shirt, and as can be seen, as the base sheet 2 is peeled away, it also peels some residue of the flock, as at 15, away from the applied transfer, and also, separates the pressure sensitive adhesive 8, pulling these components free from the applied transfer, so that only the precisely patterned flock 3, and the insert material 5, remains permanently affixed to the surface of the shirt 1.

Obviously, the transfer components and method of application as described herein can be used with a variety of different types of flock formed types of transfers, or the system may be used for application of other materials when formed into a transfer, or applique, as explained herein, or for usage for related purposes.

In addition, as previously described in the earlier patents to the inventor herein, as with the process described in the plush textured multicolored flock transfer, or as set forth in the patent to Otomine, U.S. Pat. No. 4,142,929, in the beginning of the process of the transfers formation, the carrier film 2 or paper is coated with a release adhesive, then electrostatically coated with the multicolor fibers. This has been previously described in the earlier patents, and which form the base for the plush textured flock transfer, or the style of transfer as shown in the aforesaid Otomine patent, as used in this invention, but which is flocked into a more patterned design, for being combined with a more reflective, but non-compatible type insert material.

In addition, the insert area where the insert material may be applied, once it is designed, could include various markings to help with the alignment of the insert, where ever it is bring applied to the design, which will depend upon the letter involved, the number selected, or the design of the mascot, etc., under consideration. In addition, markings may be applied to the transfer so as to indicate where placement of the insert is to be made during the method of assembly of the flock transfer herein.

If the applique is made with appropriate materials, for example, vinyl reflective surface material as compared to metallic, vinyl and/or polyester hot melt, synthetic textile versus natural fiber, the heat sealing and die cutting may be done simultaneously, with one cutting sequence, using a high frequency heat source and a metal die. In the case of the preferred type of plush transfer, as explained previously, using an insert material, that is difficult of adhering in place, during fabrication of the transfer, heat is normally applied to a base material, which is usually a textile, and then the entire transfer is die-cut out in the precise and desired shape, of the finished transfer desired to be secured to an item of clothing, or the like.

When the invention is made in the manner as described herein, it enables inserts to be located inside a fiber coated heat sealed design, with a perfect butt registration of the fibers, with no unsightly or problematic overlap, and no gaps, whatsoever, in the finished design after being applied by heat to a textile surface. When the transfer is assembled in the manner as previously described, it temporarily and inexpensively holds together the insert, in its set position, until it can be manufactured into the final fiber coated heat seal transfer, and made a permanent part of the final and assembled applied transfer. Obviously, combinations of different textures, or mixed-media type of flock, that incorporate unique materials, may be combined yet with perfect registration, and in a practical and cost effective way, is the end result of the transfer fabricated in the manner as described herein. Yet, the transfer of this type, when formed, particularly when fabricated of a mixed-media type of components, generally maintain their integrity, after the transfer has been fabricated, and applied to textile, and assures a lasting durable appearance, even after repeat usage, or washings, ever after once applied.

The transfer of this invention does not incorporate any insert material by overlapping the design around its various edges, to get some degree of registration, and this is an advantage with textile inserts which have unfinished edges, and that can come apart, as for example, during washing. For example, if part of the flock overlies the non-compatible material, then after a few washings, that peripheral or edge flock may deteriorate, or come free, and leave a very unsightly type of emblem, as applied to the jersey, etc. With many non-compatible materials, there are finished edges that do not need to be covered. And, a surface that does not adhere using commonly available thermoplastic hot melt adhesives, does not work, except when assembled in the manner as described herein to provide for its registration and application with the previously applied flock components of the applique. Instead, this current method to temporarily locate an insert material into the plush transfer, during its manufacturing process, in a stable and cost-effective manner, enables it to become a permanent part of the finished product.

Obviously, other types of non-compatible insert materials may include reflective glass lenticular plastic, vinyl, glass, metal, rubber, holograms, and the like.

Obviously, the type of hot melt adhesive that is used in this invention, as commonly known in the art, generally is fabricated as a powdered binder, with a nylon polyester, or polyester vinyl chloride type of hot melt adhesive composition. It is applied over a previously applied latex adhesive. The hot melt is applied, brushed and vacuumed, into a precise location, and is readily available for application of the flock, and further, in this instance, to the back side of the reflective material, both of which are applied directly to a shirt, or other item of clothing, or material, through the use of heat.

Other modifications particularly in the methods of incorporating the non-compatible inserts into the pre-designed flock material, as described herein, includes the cut butt-registering of pieces, heat laminating such pieces into the window of the flock, of the finished transfer, through the use of a hot melt adhesive, which may have already been pre-applied to the transfer, or through usage of a layer of overlapping hot melt material. Also, it is likely that the inserts may be placed onto the film carrier prior to printing the release adhesive, through the use of a jig, with visual guides or templates provided above for alignment, to provide for a permanent print of the adhesive at precise locations during the manufacture of the transfer. It may be likely that other materials may be blended or coated into the transfer, like polyurethane resin, into or onto the material in order for it to be able to be used like normal transfers, with the transfer hot melt adhering to the surface and therefore no longer maintaining the insert as an incompatible material, although it may yet contain some incompatible components, such as a layer of glass beads, and the like. In addition, applying the non-compatible inserts, cut to fit within the window of the fiber transfer, and onto the base material which is compatible with a hot melt, and which may overlap into the hot melt area, may be performed. This may be laminated onto the bottom of the transfer, and can also be used with colored compatible material applied to the base component, in order to hide any gaps, where overlapping of various components cannot be achieved. Another enhanced way that the method of this invention can be done, and especially for designs requiring multiple pieces of non-compatible inserts, which may include more intricate designs, is to apply another temporary carrier paper to the bottom side of the non-compatible insert, and kiss-cut the same from the top side and remove or segregate select pieces that are not desired for transfer to the fiber coated sheet, remove such liner from the pressure sensitive adhesive, and press/stick the insert pieces into place in register onto the fiber coated sheet, remove the paper liner from the top, and then screen print the flock as usual.

As a further alternative or embodiment, it appears that the concept of this invention can be accomplished by taking a segment of the non-compatible material, attach a pressure-sensitive or hot melt adhesive, stick it into the flocked transfer sheet, and then proceed with the remaining steps to secure it to a cloth or item of clothing. In certain instances, the reflective material, whether it be made reflective either through the use of beads, metal, or the like, may have a hot melt coating provided upon its top surface, as initially processed.

These are all examples of variations that can be done to achieve the finished transfer of this invention, and provide alternative steps for use in the method of its manufacture, as can be understood.

Variations or modifications to the subject matter of this invention may occur to those skilled in the art upon review of the disclosure herein. Such alternative components and procedures are considered to be within the spirit and scope of the invention as described herein. The description of the preferred embodiment as set forth herein is done so for illustrative purposes only.

What is claimed is:

1. A mixed media flock transfer with insert material comprising:

a base sheet having a surface area coated with a release adhesive;

patterned flock material having ends adhering to said release adhesive of said surface area in the form of a predetermined pattern;

insert material having a predetermined pattern that produces a desired design image when combined with the design pattern of the flock material, one side of said insert material being secured to said flocked base sheet by a pressure sensitive adhesive;

a binding adhesive applied to exposed ends of said flock and the other side of said insert material, whereby said design image formed by said flock and said insert is adapted to be transferred onto a product.

2. The transfer as set forth in claim 1 wherein said binding adhesive includes an adhesive to bind the flock and insert materials and a hot melt adhesive.

3. The transfer as set forth in claim 2 wherein said hot melt adhesive is applied as a separate adhesive layer.

4. A method of making and applying a mixed media flock transfer with insert material on a product comprising the steps of:

printing a release adhesive on a base sheet;

applying flocking material into said release adhesive to form a predetermined flock design;

cutting insert material to form a predetermined insert design;

adhering one side of the insert material to the flocked base sheet to form a desired design pattern;

applying a binding adhesive to the opposite side of the insert material and to free ends of said flock to form a transfer of said desired design pattern;

transferring said flock and insert designs associated with said desired design pattern from said base sheet to form said desired design pattern on a surface of a product.

5. The method as set forth in claim 4 wherein the step of transferring the desired design pattern to said product includes the steps of subjecting binding adhesive to heat and pressure.

6. The method as set forth in claim 5 wherein said binding adhesive comprises an adhesive to bind the fibers and a hot melt adhesive.

7. The method as set forth in claim 6 wherein said hot melt adhesive is applied as a separate adhesive layer.

8. The method as set forth in claim 5 further including the step of removing said base sheet following the application to a product by heat and pressure.

9. The method as set forth in claim 4 wherein the step of applying binding adhesive to exposed insert material and flock includes the steps of applying a screen print permanent latex fiber over the materials, applying a coating of hot melt powder over the latex fiber adhesive, allowing the hot melt powdered coating to dry, vacuum brushing the coating and curing the coating.

10. The method as set forth in claim 4 wherein the step of adhering said insert design to said flocked base sheet includes the steps of printing a pressure sensitive adhesive to a carrier paper sheet, applying one side of said insert material to said pressure sensitive adhesive, peeling the carrier paper from pressure sensitive adhesive, positioning said pressure sensitive adhesive and insert material on the previously flocked base sheet, and applying pressure to the adhesive to secure the insert material to the flocked base sheet.

* * * * *